United States Patent [19]

Moose

[11] Patent Number: 4,633,615

[45] Date of Patent: Jan. 6, 1987

[54] TRACK-INTER-LOCKING ROLLER WHEEL ASSEMBLY FOR SLIDING PATIO DOORS

[75] Inventor: James R. Moose, Miami, Fla.

[73] Assignee: Watsco Inc., Hialeah, Fla.

[21] Appl. No.: 752,668

[22] Filed: Jul. 8, 1985

[51] Int. Cl.[4] ..... E05D 13/02

[52] U.S. Cl. ..... 49/425; 16/100; 16/105

[58] Field of Search ..... 49/425, 404; 16/97–100, 105, 106

[56] References Cited

U.S. PATENT DOCUMENTS

| | | | |
|---|---|---|---|
| 2,659,939 | 11/1953 | Greig | 49/425 |
| 3,033,285 | 5/1962 | Banner | 49/425 |
| 3,167,112 | 1/1965 | Tucker | 49/425 |
| 3,956,854 | 5/1976 | Yamamoto | 49/425 |
| 4,262,451 | 4/1981 | Dallaire | 49/425 |

*Primary Examiner*—Philip C. Kannan

*Attorney, Agent, or Firm*—Ernest H. Schmidt

[57] ABSTRACT

Broadside displacement of sliding patio doors from their building framework for removal from the threshold track upon lifting of the doors in attempts at unauthorized entry is prevented with the use of downwardly-extending leg portions at each side of the door roller wheel assemblies, which leg portions extend downwardly of each side of an upstanding threshold track projection upon which the roller wheels ride. In one embodiment of the invention, the roller wheel assembly leg portions terminate in mutually inwardly-directed hook portions received in slightly spaced relation below rectangular shoulders defined by a rounded head formed along the upper end of the upstanding track projection, thereby preventing removal of the roller wheel assemblies from the threshold track for unauthorized entry.

1 Claim, 9 Drawing Figures

TRACK-INTER-LOCKING ROLLER WHEEL ASSEMBLY FOR SLIDING PATIO DOORS

This invention relates to sliding glass patio doors, and is directed particularly to improvements in the roller wheel assemblies for such doors.

Roller wheel assemblies for sliding patio doors heretofore devised are vulnerable to easy removal from their building framework threshold track for unauthorized entry or break-in simply by lifting the doors sufficiently to allow passage of the roller wheels over the threshold track for broadside displacement.

It is, accordingly, the principal object of this invention to provide a novel and improved roller wheel assembly for sliding patio doors that prevents sufficient lifting of the doors from their threshold track to allow for broadside displacement and removal in attempts at unauthorized entry or break-in.

A more particular object of the invention is to provide sliding patio door roller wheel assemblies having downwardly-extending leg portions at each side which, upon assembly of the door upon the threshold track in a building framework within which the patio door is received, extend downwardly at each side of an upstanding threshold track projection upon which the roller wheels ride, thereby preventing sufficient lifting of the door for broadside removal from the threshold track.

Yet another object of the invention is to provide roller wheel assemblies of the character described wherein the downwardly-extending leg portions terminate in mutually inwardly-directed hook portions received in slightly spaced relation below rectangular shoulders defined by a rounded head formed along an upstanding track projection upon which the roller wheels ride, thereby preventing removal of the roller wheel assemblies from the threshold track for unauthorized entry.

Yet another object of the invention is to provide a track inter-locking roller wheel assembly for sliding patio doors of the above nature which will be simple in construction, easy to operate, dependable in performance, and durable in use.

Other objects, features and advantages of the invention will be apparent in the following description when read with reference to the accompanying drawings.

BRIEF DESCRIPTION OF THE DRAWINGS

In the drawings, wherein like reference numerals denote corresponding parts in each of the several views:

Referring now in detail to the drawings, reference numeral 10 in FIGS. 2, 3 and 4, designates, generally, an interlocking roller wheel assembly embodying the invention illustrating its cooperative use with a threshold track 12 of a sliding patio door assembly 11 (see FIG. 1). As illustrated in FIG. 5, roller assembly 10 is assembled within the bottom rail at each end of each sliding patio door in the manner and for the purpose hereinbelow more particularly described.

Figure 1:
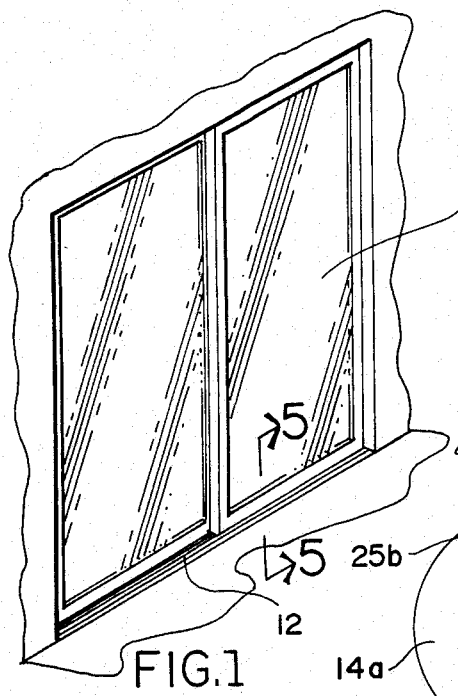
FIG. 1 is an oblique view of a patio door installation equipped with a roller wheel assembly embodying the invention.
Figure 2:
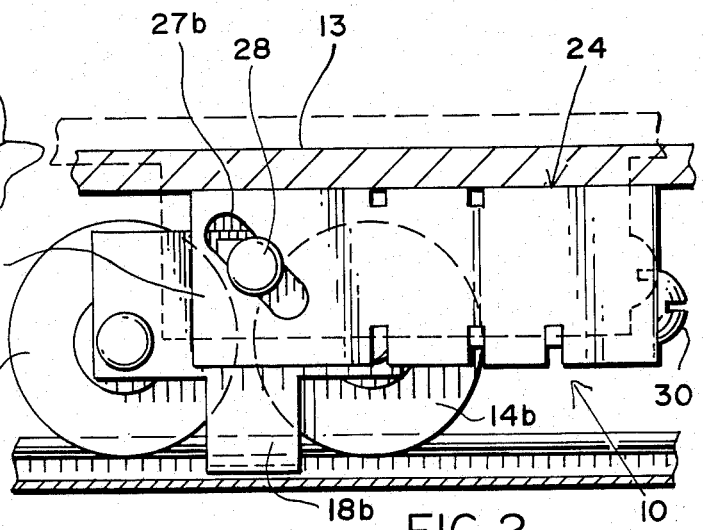
FIG. 2 is a side elevational view of one form of dual wheel assembly embodying the invention, shown as installed in the patio door and its threshold track (partially illustrated)
Figure 3:
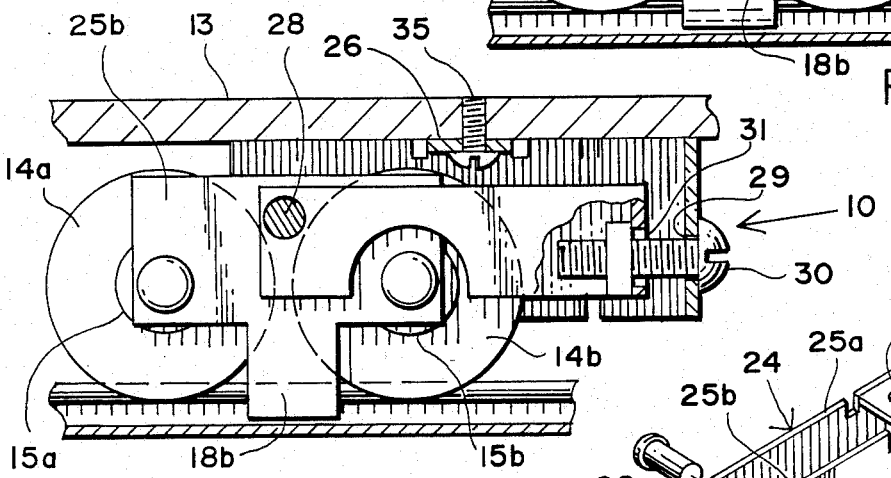
FIG. 3 is a side elevational view similar to that of FIG. 2, but with portions broken away to reveal constructional detail.
Figure 5:
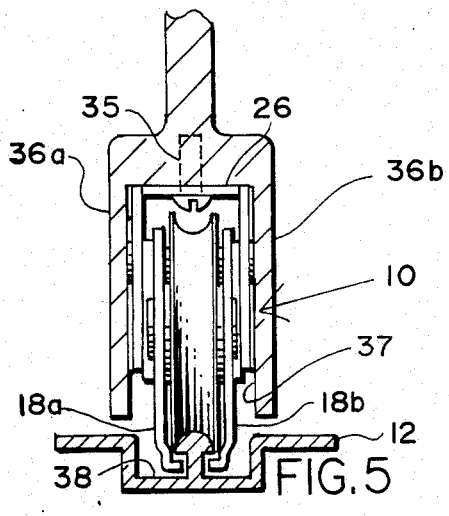
FIG. 5 is a transverse, cross-sectional view taken along the plane indica at 5—5 of FIG. 1.

The two wheel roller assembly 10 comprises a pair of peripherally grooved roller wheels, 14*a*, 14*b*, having roller bearing hubs 15*a*, 15*b*, respectively. The roller wheels, 14*a*, 14*b*, are retained in axially spaced relation between a pair of flat, sheet metal carriage plates, 16*a*, 16*b*, to which they are rotatively secured by respective rivet journal pins, 17*a* and 17*b*. The carriage plates, 16*a*, 16*b*, are integrally formed with central, downwardly-projecting leg portions 18*a*, 18*b* (See FIG. 60, terminating in respective inwardly-directed, mutually spaced and facing hook portions 19*a* and 19*b*, respectively. As is hereinafter more particularly described, the hook portions 19*a* and 19*b* inter-engage with the threshold track 12.

The carriage plates and wheels assembly just described is pivotally received between the opposed legs of a bent sheet metal, U-shaped carrier member 20. To this end, the U-shaped carrier member 20 is provided, near the outer end of its opposed legs, with a pair of transversly aligned openings, 21*a*, 21*b*, which are in register with aligned openings 22*a*, 22*b*, in central upper portions of the carriage plates, 16*a*, 16*b*, respectively. Semi-circular recesses, 23*a*, 23*b*, centrally located along lower edges of the legs of U-shaped carrier member 20, provide clearance for the outwardly-projecting hub portions of the inner roller wheel 14*b*.

The just described carrier member 20 is, in turn, received in sliding relation between the opposed legs, 25*a*, 25*b* of a U-shaped, bent sheet metal outer cage or housing 24. The housing leg 25*b* is stamped with an upwardly-extending rectangular portion which is bent over and welded along its outer edge to the top edge portion of the opposed leg 25*a* to form a strengthening bridge 26.

A pair of opposed laterally-aligned, inclined slots 27*a*, 27*b* are provided near the outer ends of the opposed legs 25*a*, 25*b* of the U-shaped cage 24, for the transverse reception therethrough and therebetween of an assembly rivet 28 extending through said inclined slots, the aligned openings 21*a*, 21*b* of the carrier member 20 and the aligned openings 22*a*, 22*b* of the carriage plates 16*a* and 16*b*.

Means is provided for adjustably moving the carrier member 20 with its pivoted wheel assembly back and forth within the U-shaped, bent sheet metal outer cage 24. For this purpose, the enclosed end of the cage 24 is provided with a circular opening 29 through which a machine screw 30 extends. Machine screw 30 also extends through a circular opening 31 in the closed end of carrier member 20 for inter-threading reception within a square nut captured within the bight of said carrier member, so as to prevent relative turning of said nut upon the threading in or out of machine screw 30. In operation, it will be understood that as machine screw 30 is screwed into the square nut 32, the U-shaped carrier member 20, together with the roller wheels, 14*a* and 14*b* assembled thereto, will be moved backwardly within the outer cage or housing 24. At the same time, because such motion is constrained by movement of the assembly rivet 28 within the inclined slots 27*a*, 27*b* of said cage or housing, the carrier member and wheels assembly will be moved downwardly or outwardly with respect to said cage or housing. Adjustment of the machine screw 30 thus provides for vertical adjustment of the roller wheel assembly of a patio door for proper vertical fit in its frame, as is herein below more particularly described.

As means for securing the roller wheel assembly to the bottom rail of a sliding patio door assembly, a screw hole opening 33 is provided in the bridge tab 26 of the cage or housing 24, through which a mounting screw 35 can be received for its securement within the recess 37 defined by spaced, parallel side walls, 36*a* and 36*b* of said bottom rail. It will be understood that a roller wheel assembly will be installed near each end of the patio door lower rail for rolling support within the doorway opening frame, including the threshold track 12.

Figure 4:
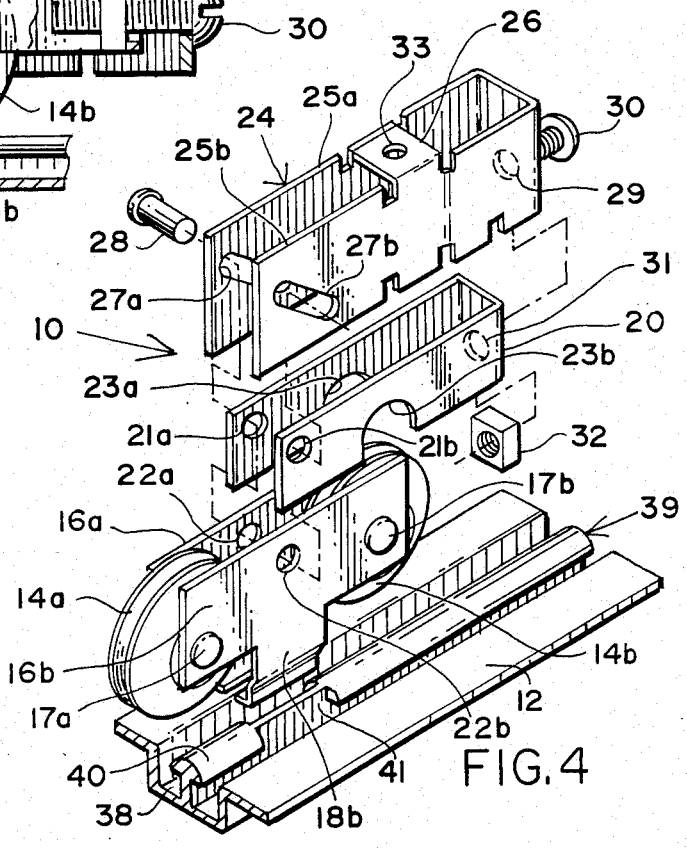
FIG. 4 is an "exploded" view of the roller wheel assembly illustrated in FIGS. 2 and 3, shown separately of a patio door but in association with a portion of the threshold track to illustrate the inter-connecting mechanism.
Figure 6:
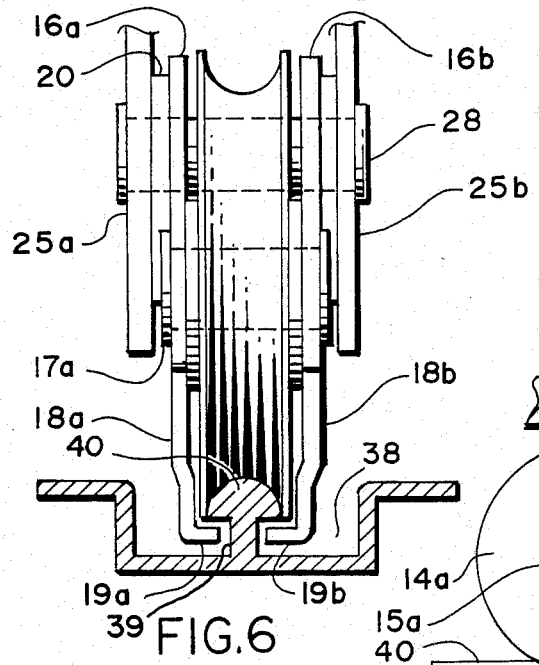
FIG. 6 is an enlarged view of the track and roller wheel assembly inter-hooking mechanism.

As best illustrated in FIGS. 4 and 6, the threshold track 12, which will preferably be fabricated of an aluminum extrusion, is formed, in cross-section, with a rectangular depression or recess 38, having an upstanding, headed post 39. The rounded post head 40 defines opposed, square shoulders at the underside, underwhich the hook portions 19*a*, 19*b* of the roller wheel assembly project. To provide for such interfitting assembly between the roller wheel assembly and the threshold track 12, opposed post head portions are cut away at selected portions along the track, as indicated at 41 in FIG. 4.

Thus, upon fitting a sliding patio door assembly 11 in place within the door opening framework, the hook portions 19*a*, 19*b* of each of the dual wheel roller assemblies 10 near each end of the bottom rail of the door being installed, will be fitted through cut away portions 41 of the threshold post head portions 40. The roller wheels 14*a* of the roller wheel assemblies will then be allowed to fit down upon the upstanding headed post 39 for rolling back and forth along the threshold track 12. It will be understood that the cut away portions 41 of the upstanding headed post 39 will be placed along the track so that the patio door can be assembled or removed from the track only when the door is in partially or fully opened position, so that when the door is closed and locked, inter-hooking engagement of the hook portions 19*a*, 19*b* of the roller wheel assemblies 10 with the undersides of the head portion 40 of upstanding headed post 39 of the threshold track prevents upward displacement of the door in attempts to remove it from its track for unauthorized entry or breaking in. As described above, upon assembly of the patio door to its door opening framework, including the threshold track 12, the vertical adjustment screw 30 will first be in loosened position to allow for full withdrawal of the roller wheels 14*a*, 14*b*, and thereby allowing the upper rail of the door to be placed within the framework header track by broadside movement, after which the adjustment screw 30 will be inwardly adjusted with respect to the nut 32 to provide for relative downward movement of the roller wheels 14*a*, 14*b* and upward movement of the door, thereby capturing the door within the upper framework track.

Figure 7:
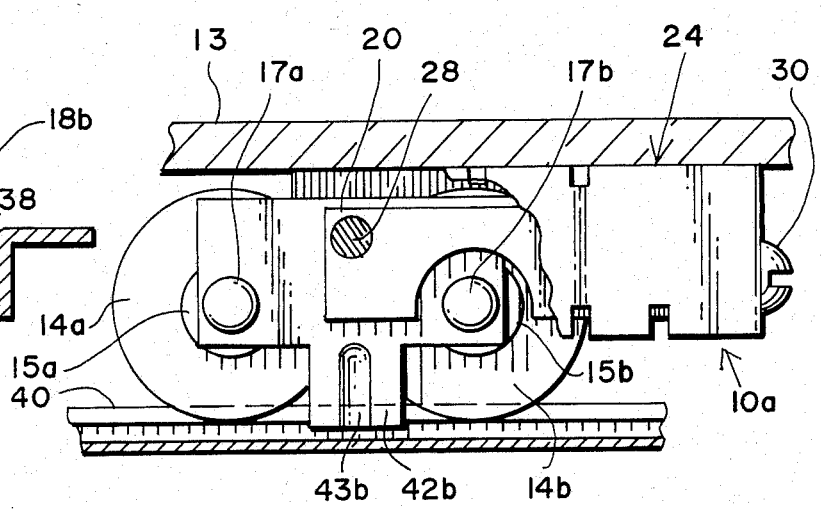
FIGS. 7, 8 and 9 are similar to FIGS. 3, 4 and 6, respectively, illustrating a modification of the roller-wheel assembly.
Figure 8:
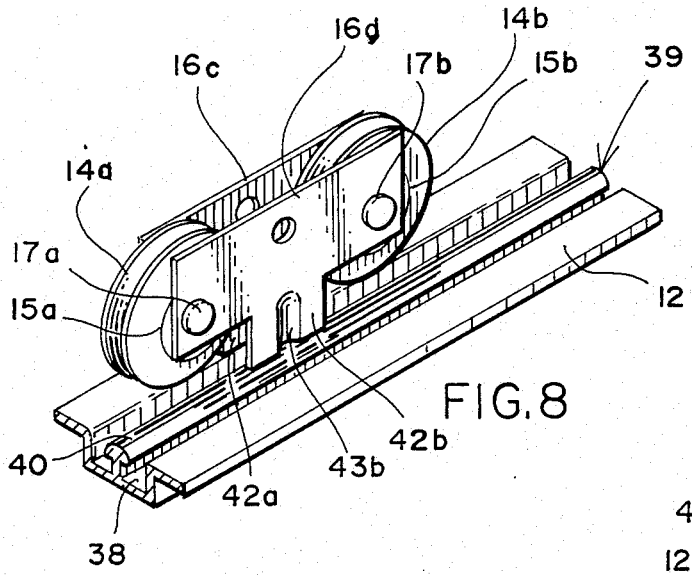
Figure 9:
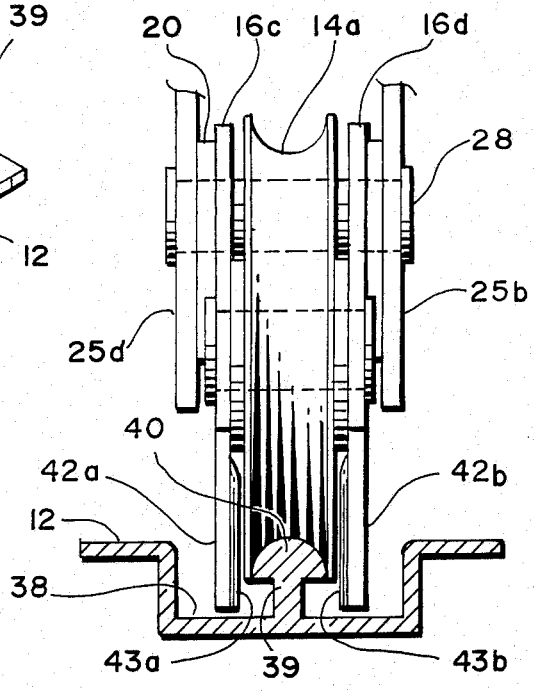

FIGS. 7, 8 and 9 illustrate a modification of the roller wheel assembly as above described, differing only in that carriage plates 16*c*, 16*d* are formed with straight, outwardly and downwardly projecting leg portions 42*a*, 42*b*, having central, vertically extending, inwardly stamped depressions, 43*a*, 43*b*. With such construction, it will be observed with reference to FIG. 9, for example, that upon installation of a patio door, the roller wheel assembly leg portions 42*a*, 42*b*, project downwardly within the threshold track groove 38 in close proximity to diametrically-opposed portions of the upstanding headed post of the threshold track. The leg portions 42*a*, 42*b* therefore prevent broadside displacement of an installed patio door without such lifting off the track as would be incapable of achieving because of the limited permissible upward movement within the header track of the patio door framework opening.

While I have illustrated and described herein only two forms in which my invention can conveniently be embodied in practice, it is to be understood that these forms are presented by way of example only and not in a limiting sense. The invention, in brief, comprises all the embodiments and modifications coming within the scope and spirit of the following claims.

What I claim as new and desire to secure by Letters Patent is:

1. In a track inter-locking roller wheel assembly for sliding patio doors of the type having one or more sliding doors and a building framework within which the doors slide, including a threshold track having an upstanding longitudinal projection upon which the sliding patio doors are rollingly supported by roller wheel assemblies mounted near each end of the bottom rails of each of the patio doors, and further including mechanism for vertical adjustment of the roller wheel assemblies relative to their respective doors, and wherein the upper rail of the building framework has a longitudinal groove within which upper end rail portions of the sliding patio doors are received for sliding movement therealong, the improvement comprising; a pair of opposed, downwardly-extending leg portions provided one at each side of each of said roller wheel assemblies, said leg portions extending below lower-most peripheral portions of the wheels of their respective roller wheel assemblies, said leg portions extending downwardly of each side of the threshold track projection upon the sliding patio doors being installed in the building framework and being adapted to prevent broadside displacement of the doors for removal from the threshold track upon lifting of the doors in attempts at unauthorized entry, said downwardly-extending leg portions being of sheet metal formed with vertically-extending, inwardly-stamped, rounded depressions facing opposed side portions of the upstanding threshold projection.

* * * * *